US005787754A

United States Patent [19]

Carrion et al.

[11] Patent Number: 5,787,754

[45] Date of Patent: Aug. 4, 1998

[54] TOOL FOR COMPRESSION OF MOTOR/ GENERATOR WINDINGS

[76] Inventors: Jose Carrion, Junine #903 y Escobedo, Guayaquil, Ecuador; Michael A. Franek, 1449 Gillespie Ave., Bronx, N.Y. 10461

[21] Appl. No.: 191,425

[22] Filed: Feb. 3, 1994

(Under 37 CFR 1.47)

Related U.S. Application Data

[63] Continuation-in-part of Ser. No. 21,805, Feb. 24, 1993, abandoned.

[51] Int. Cl.[6] ..... B21D 5/01

[52] U.S. Cl. ..... 72/407; 72/416; 72/452.7; 72/453.15; 29/753

[58] Field of Search ..... 72/453.15, 453.16, 72/407, 409.01, 409.12, 409.14, 409.18, 416, 452.7; 29/751, 753

[56] References Cited

U.S. PATENT DOCUMENTS

| | | | |
|---|---|---|---|
| 2,693,218 | 11/1954 | Freedom | 72/407 |
| 2,885,681 | 5/1959 | Dater | 72/407 |
| 2,921,315 | 1/1960 | Albrecht et al. | 72/407 |
| 3,015,824 | 1/1962 | Richardson | 72/409.01 |
| 3,451,250 | 6/1969 | Rolf et al. | 72/407 |
| 3,972,218 | 8/1976 | Pawloski | 72/453.16 |
| 4,109,504 | 8/1978 | Rommel | 72/453.16 |
| 4,558,584 | 12/1985 | Myers | 72/407 |
| 4,571,975 | 2/1986 | Pawloski et al. | 72/407 |
| 5,040,400 | 8/1991 | Nastasi | 72/453.16 |
| 5,272,811 | 12/1993 | Armand | 72/453.15 |
| 5,381,686 | 1/1995 | Thorup | 72/453.15 |

*Primary Examiner*—David Jones

*Attorney, Agent, or Firm*—Brooks Haidt Haffner & Delahunty

[57] ABSTRACT

A tool having a pair of opposed jaws with compression surfaces that are movable in a direction essentially perpendicular to the planes of the compression surfaces can be used to apply evenly distributed compressive force to opposed faces of a flat object. A specific application of the tool is the compression of conductive copper clips joining the ends of bars that form the stator coils of electric power generators.

11 Claims, 5 Drawing Sheets

TOOL FOR COMPRESSION OF MOTOR/ GENERATOR WINDINGS

CROSS REFERENCE TO RELATED APPLICATION

This application is a continuation-in-part of prior application Ser. No. 021,805, filed Feb. 24, 1993, now abandoned.

BACKGROUND OF THE INVENTION

The tool of the invention applies evenly distributed compressive force to opposed faces of a substantially flat object such as the connector clip or bus which joins the ends of the bars employed in generator coils.

The stators of large electrical power generators have coils which consist of a plurality of conductive elements called bars. These bars are actually flat bundles of elongated strip-like electrical conductors, each conductor strand being rectangular in section. At the ends of the stator the bars of the coil reverse direction, forming coil loops. Rather than forcing these bundles of connectors through a sharp reversing bend at end of the stator, it has been found preferable to have the numerous individual bars terminate at the ends of the stator and to join the ends of pairs of bars with conductive clips. The clip is a relatively massive, flat block of conductive material, ordinarily copper, with two spaced, parallel, transversely extending openings or slots. Each rectangular slot of the clip receives the flat bundle of conductors which constitute an end of a bar. Beyond the end of the bar, the bundle of conductors can be covered with suitable insulating material. The end portion of the bar is free of insulation. The connection between the clip and the bar is soldered. A pair of joined bars connected by a clip constitutes a coil loop.

At one time it was thought that silver soldering of the copper conductors within the slots of the copper clips was sufficient to hold the bars in place and in good electrical contact. It has subsequently been found desirable to compress the clip mechanically with the conductors therein to align the flat conductor strands prior to silver soldering and to compress the clip again after soldering. This compressing of the clips while the bars are in place in a stator cannot be done effectively with conventional tools because there is very little work space between adjacent clips.

The fact that hundreds of these compressing operations are required when, as a routine maintenance procedure, a generator is overhauled, created a need for a tool which can be employed in the narrow space available, to apply uniform pressure to opposite side faces of the clip to squeeze the sides of the slot tightly about the bundle of conductors that constitute the bar. The tool of the present invention serves this purpose, and can also be used in any other similar situation where the application of compressive force within a limited space is desired.

SUMMARY OF THE INVENTION

The compression tool of the invention has a pair of jaws with opposable flat inner faces. The jaws are pivotably mounted to be swung toward each other to compress an object such as a conductive connecting clip employed in connecting bars of a generator stator coil. As the jaws of the tool approach each other, they are guided to a generally parallel relationship, and at the position at which the jaws are in opposed relationship about the object to be compressed, the jaws approach the surfaces of the object along an essentially straight path perpendicular to the surface of the object. This parallel motion begins while the jaws are spaced apart by a substantial distance, say about one inch. Because of the essentially parallel relationship of the jaws, the space in which the tool is employed can be quite restricted. The space needed for insertion of the jaws of the tool about an object such as a conductor clip need not be much larger than the thickness of the jaws themselves.

A fluid actuated piston and cylinder assembly is employed to provide the considerable force required to compress a relatively rigid object such as the copper conductor clip used to connect the ends of bars in the stator of an electric power generator. By using hydraulic actuation it is possible to compress such a clip much more effectively than with manual tools such as pliers.

The tool has a body in the form of a yoke with a movable jaw pivotably mounted on each arm of the yoke. A reciprocably movable piston, connected to the jaws by a clevis and pin, serves to move the jaws to which the piston is connected so that the jaws pivot about pins on arms of the yoke. Rollers coact with curved cam surfaces on interior parts of the jaws to guide the motion of the jaws, converting the reciprocating movement of the piston into movement of the jaws toward and away from each other.

The piston is mounted on the face of an annular head that is movable within a cylinder to retract the piston when hydraulic fluid under pressure within the cylinder chamber overcomes the force of a spring which normally urges the piston forward toward a condition in which the jaws are spaced apart from each other.

In securing a conductive clip to the bundles of conductors which constitute the insulation-free ends of bars of a stator of an electrical power generator, the ends of the bars are inserted into slots in the bar-shaped clip. The slots are sized to receive the stranded ends closely and neatly.

The tool of the invention is then inserted so that the jaws are spaced from opposite side faces of the clip at the portion of the clip which surrounds the slot. Hydraulic pressure is supplied to the cylinder of the tool, the jaws approach each other, and the clip is compressed, aligning the strands of the bundle of conductors constituting the end of the bar and assuring a good copper to copper mechanical connection. The compressive force of the tool is relaxed by relieving the hydraulic pressure and silver solder is introduced into the slot to secure the bar yet more firmly in place. After soldering, the tool is again actuated by means of hydraulic pressure to compress the clip by moving the jaws toward each other. The bars are fixed securely in good mechanical and electrical contact with the clip.

These and other features, advantages and applications of the tool of the invention will be more fully understood from the following detailed description of a preferred embodiment of the tool, especially when that description is read with attention to the accompanying figures of the drawing.

BRIEF DESCRIPTION OF THE DRAWINGS

In the drawings, in which like reference characters designate like parts throughout.

DETAILED DESCRIPTION OF PREFERRED EMBODIMENT

Figure 2:
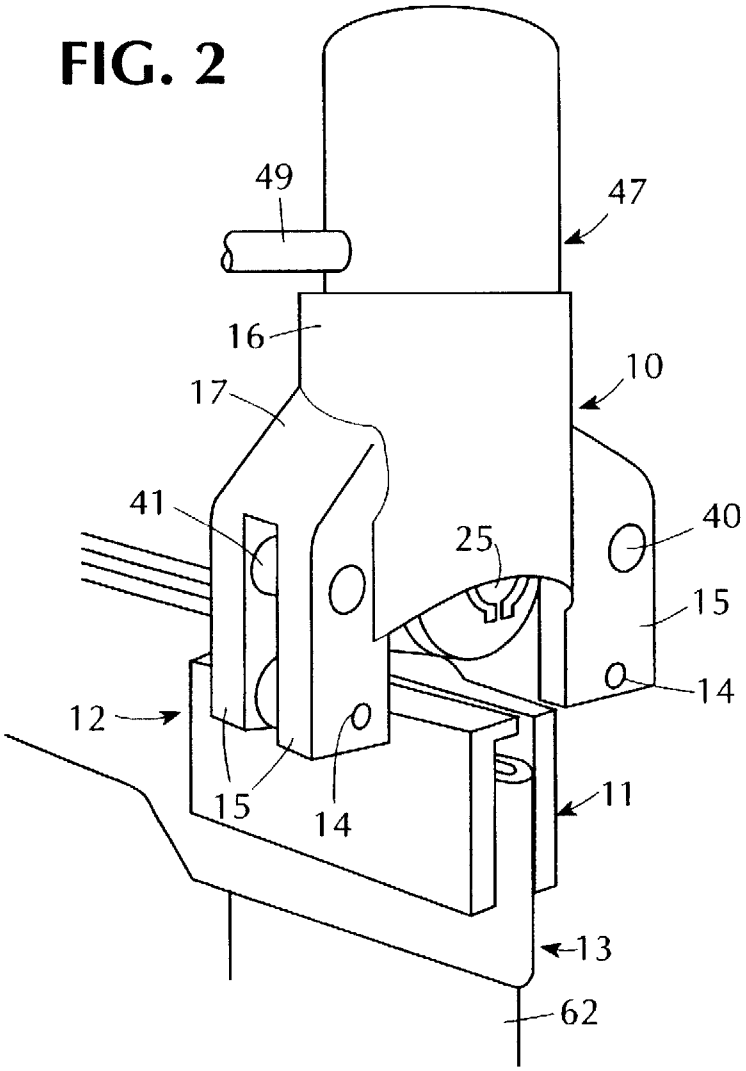
FIG. 2 is a perspective view similar to that of FIG. 1 with the jaws of the tool closed about a clip to be compressed.
Figure 1:
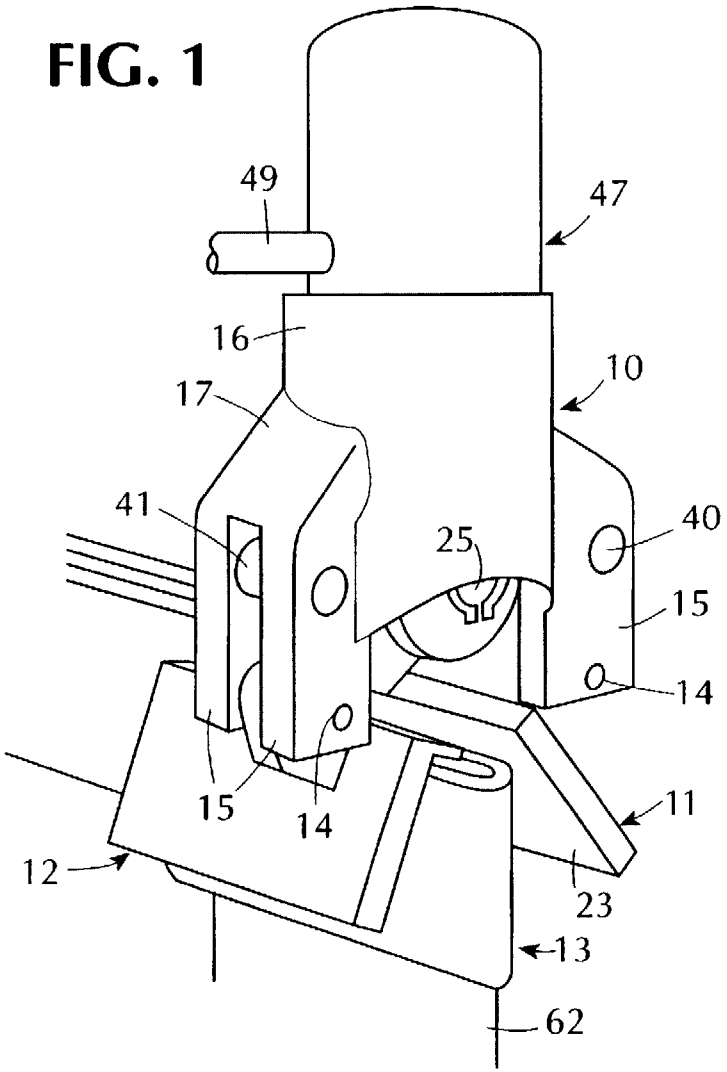
FIG. 1 is a view in perspective of the tool of the invention positioned about a clip to be compressed. The jaws of the tool are shown expanded to an exaggerated extent to illustrate jaw movement.

The compression tool of the invention, generally designated by the reference numeral 10, has a pair of opposable jaws 11 and 12 movable between an open position shown in FIG. 1 and a closed position shown in FIG. 2. The jaws 11 and 12 need not be as widely spread apart as they are shown in FIG. 1 to be positioned at opposite sides of an object such as the connector clip generally designated by the reference numeral 13, so the tool 10 can be used in applications where space is restricted, as for example in compressing the closely spaced connector clips of the rods of a stator in an electrical power generator. Under such conditions of restricted space the jaws 11 and 12 can be brought together towards the closed condition shown in FIG. 2 in which the jaws 11 and 12 are spaced apart only to the extent needed to allow reception of the clip 13 into the space between the jaws 11 and 12.

The jaws 11 and 12 are pivotably mounted on pins 14 extending through spaced pairs of arms 15 that extend from opposite sides of a central barrel-shaped portion 16 of the generally yoke-like body 17 of the tool 10.

Figure 3:
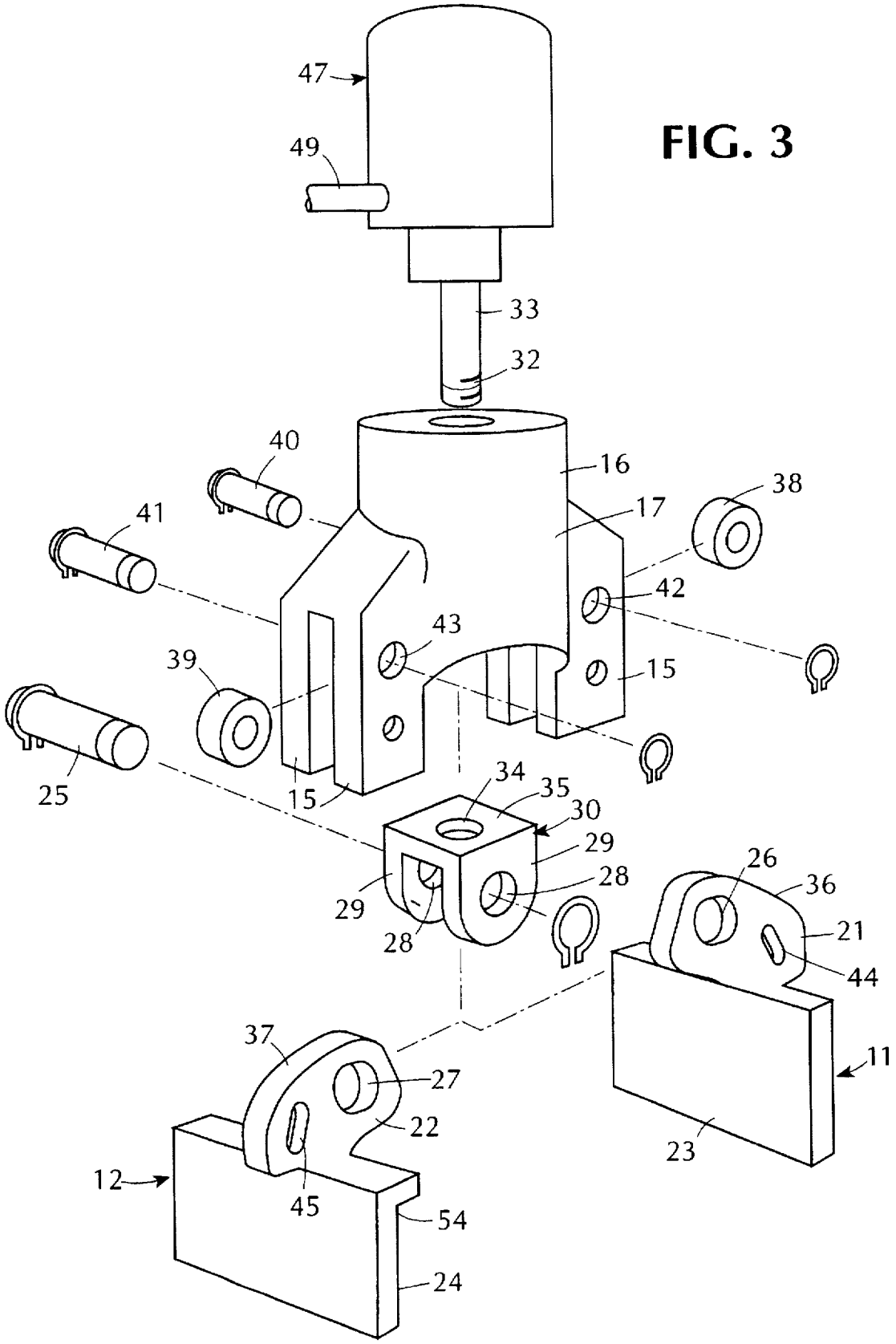
FIG. 3 is an exploded view, in perspective, of the tool of the invention.
Figure 4:
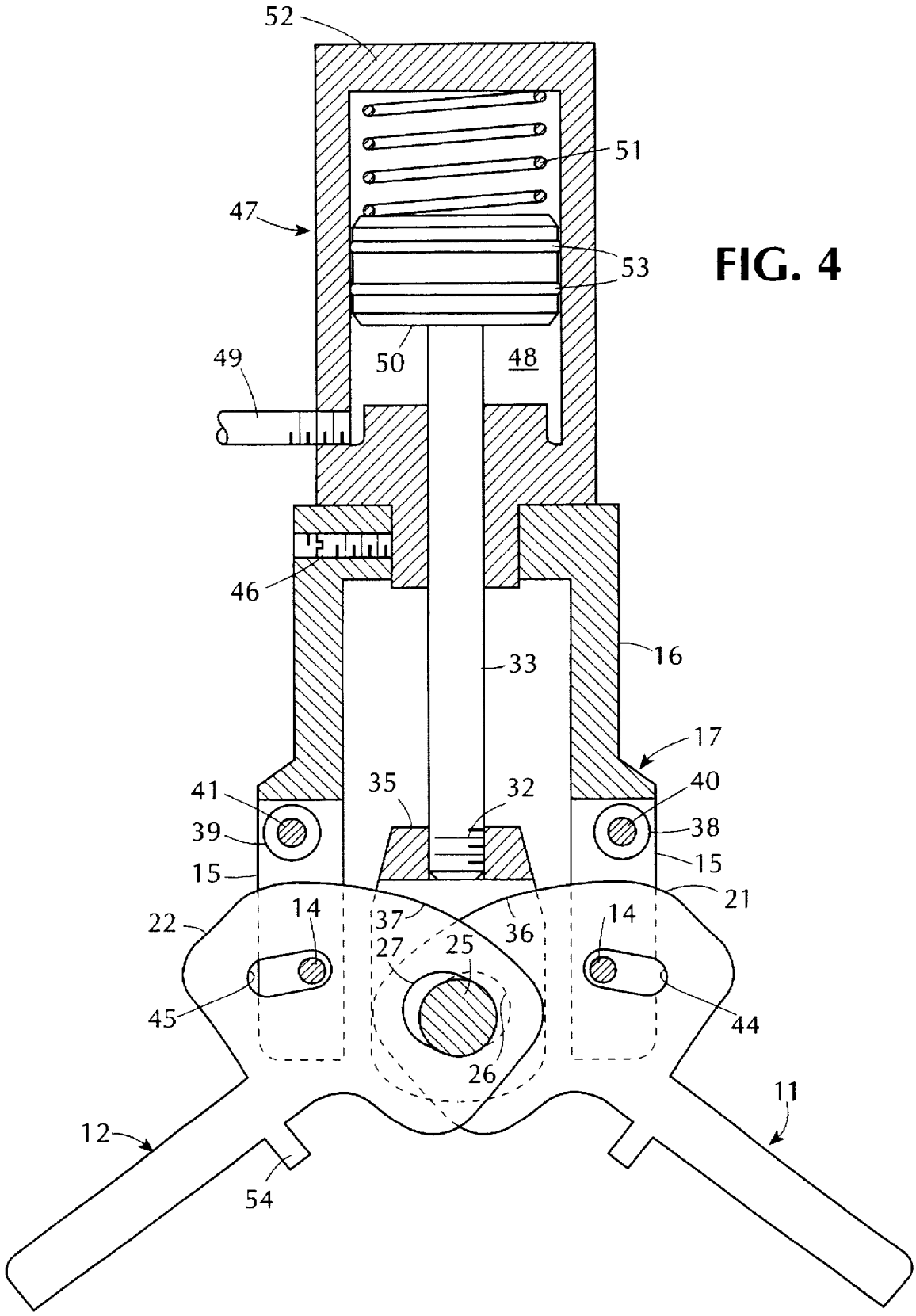
FIG. 4 is a side view, partially in section of the tool of the invention with the jaws open.
Figure 5:
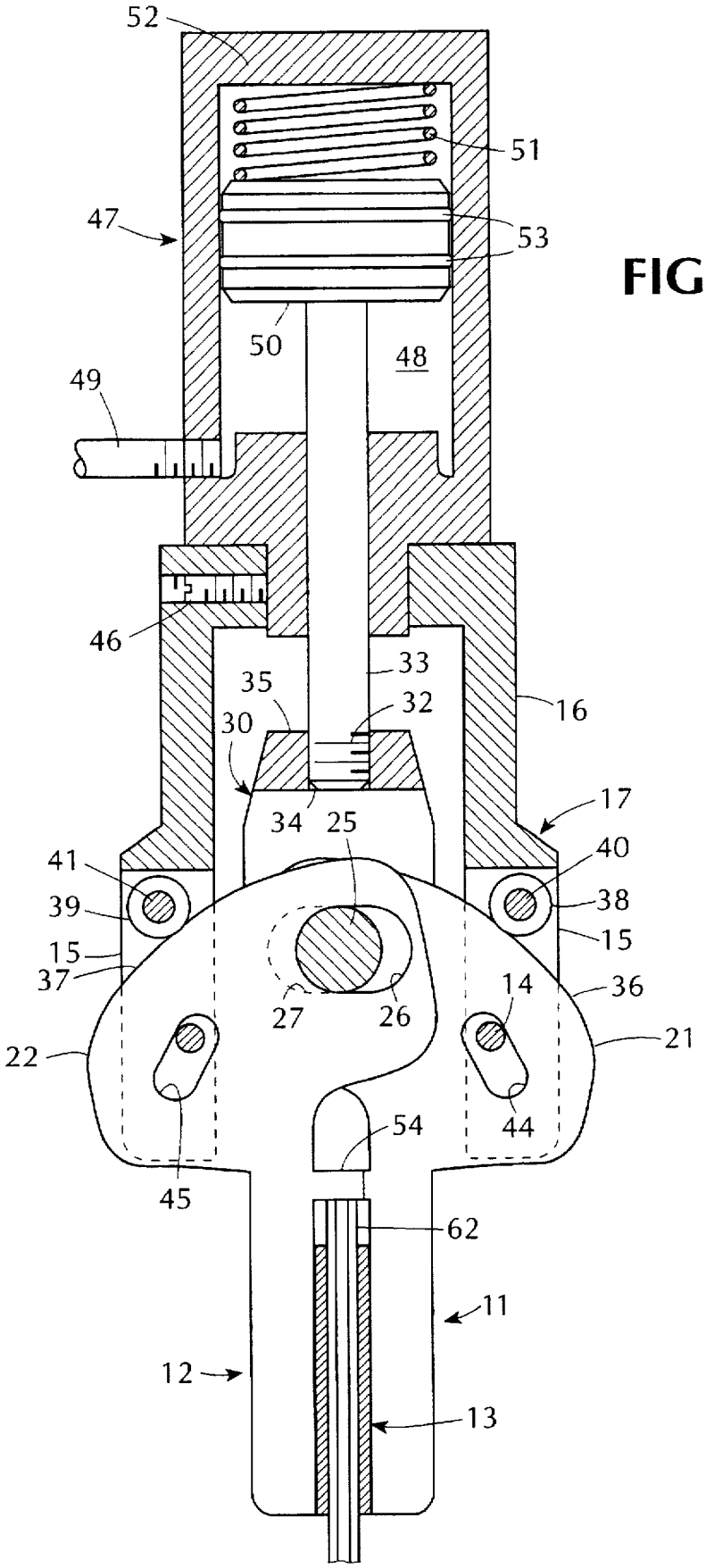
FIG. 5 is a view similar to that of FIG. 4 with the jaws of the tool in closed condition.

As best seen in FIGS. 3–5, the jaw 11 has an ear 21 and the jaw 12 has an ear 22. The ears 21 and 22 extend perpendicularly with respect to the flat compression surfaces 23 and 24 of the jaws 11 and 12 respectively and are displaced somewhat from the centerlines of their respective jaws so that the ears 21 and 22 overlap. A central pin 25 passes through apertures 26 and 27 bored through the overlapping portions of the ears 21 and 22. Preferably the apertures 26 and 27 are elongated and slotlike as shown in FIG. 5 to permit relative sliding movement as well as relative pivoting of the jaws 11 and 12. The ends of the central pin 25 pass through the aligned holes 28 in the arms 29 of a clevis 30.

The threaded end 32 of a piston rod 33 is received in a threaded hole 34 in the central web 35 of the clevis 30 so that movement of the piston 33 is conveyed through the clevis 30 via the central pin 25 to the jaws 11 and 12. Retraction of the piston rod 33 moves the jaws 11 and 12 from the open position of FIG. 4 to the closed position of FIG. 5.

The ears 21 and 22 of the jaws 11 and 12 have smoothly curved outer camming surfaces 36 and 37 which contact rollers 38 and 39 mounted on pins 40 and 41 fitted in aligned pairs of holes 42 and 43 passing through the pairs of arms 15. These curved camming surfaces guide the movement of the jaws 11 and 12 in such a way that as the compression surfaces 23 and 24 approach each other the surfaces 23 and 24 are brought into an essentially parallel relationship for applying even pressure against opposite side faces of the clip 13 as shown in FIGS. 2 and 5. In order to allow this alignment of the jaws 11 and 12, the holes 44 and 45, through which the pivot pins 14 pass, are elongated as shown in FIGS. 3–5.

The freedom of the ears 21 and 22 of the jaws 11 and 12 to reposition themselves with respect to the arms 15 that is allowed by the loose fit of the pins 14 in the holes 44 and 45 permits the jaws 11 and 12 to approach each other with their respective compression surfaces 23 and 24 in parallel relationship. The shifting of pins 14 with respect to the jaws 11 and 12 is seen by comparing the view of FIGS. 4 and 5.

In order to apply the considerable force required to compress and deform a relatively rigid object such as the clip 13, the tool 10 is preferably powered by a hydraulic piston/cylinder unit generally designated by the reference numeral 47. The piston/cylinder unit 47 is shown secured to the tool body 17 by means of a screw 46, but the cylinder 47 could be formed integrally with the body 17 or otherwise secured thereto. The piston rod 33 of the unit 47 extends axially through the barrel-shaped portion of the tool body 16, with the end 32 of the rod 33 secured to the clevis 30 as described above.

The piston/cylinder unit 47 can be a conventional, preferably compact assembly of the type in which hydraulic fluid is supplied under pressure to a chamber 48, as through the line 49 illustrated from a source of fluid under pressure such as a pump (not illustrated). The entry of the hydraulic fluid through the line 49 into the chamber 48 exerts pressure on the head 50 secured to the piston rod 33, forcing the head 50 and piston 33 secured thereto from the position shown in FIG. 4 to the retracted position illustrated in FIG. 5. A powerful coiled spring 51 under compression between the piston head 50 and the closed end 52 of the piston/cylinder assembly 47 opposes retraction of the piston, and restores the head 50 and rod 33 to the condition shown in FIG. 4 when the hydraulic pressure is relieved. Suitable seals, such as O-rings 53, prevent leakage of hydraulic fluid from the chamber 48.

When hydraulic fluid under pressure is supplied to the piston chamber 48, the piston head 50 is forced toward its retracted position as shown in FIG. 5. This pulls back the piston rod 33 and the clevis 30, and causes the jaws 11 and 12 to move towards each other as the camming surfaces 36 and 37 ride on the rollers 38 and 39, compressing an object such as the clip 13 between the compression surfaces 23 and 24. The jaw 12 preferably has an inwardly projecting lip 54 which limits the movement of the jaws 11 and 12 towards each other and also serves as a stop for preventing insertion of the tool 10 too far when the tool 10 is positioned about an object such as a clip 13 to be compressed. Aside from the lip 54 on the jaw 12, the jaws 11 and 12 are essentially symmetrical to each other in shape.

Figure 6:
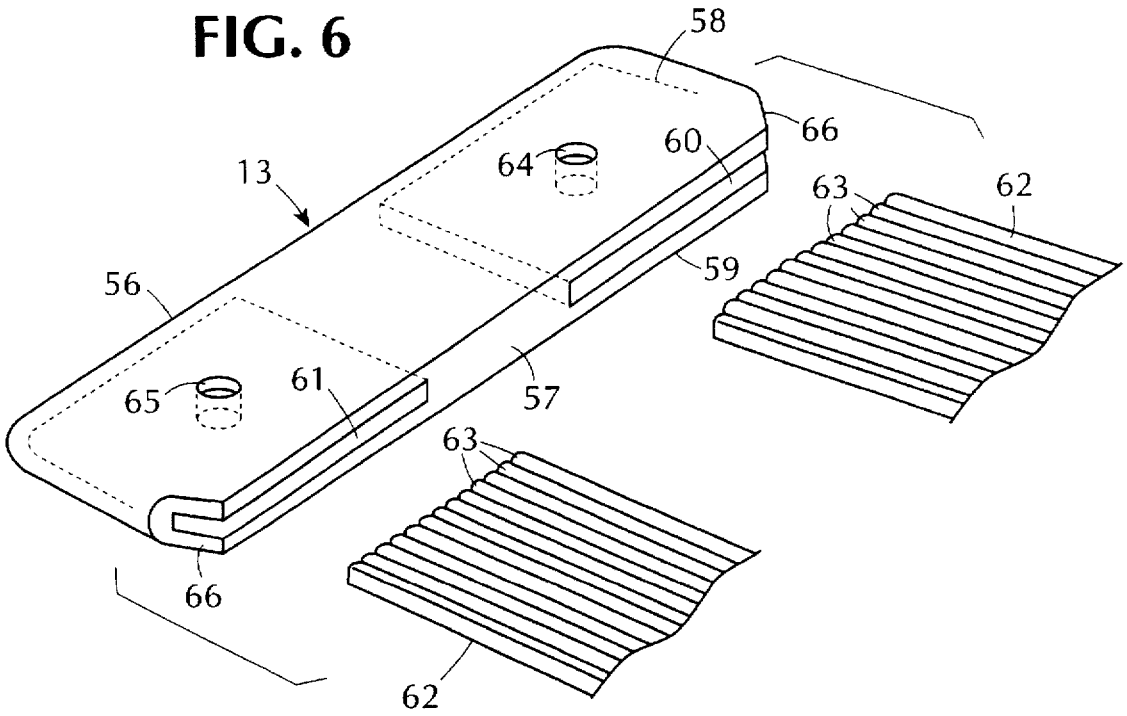
FIG. 6 is a perspective view of a typical conductor clip prior to insertion of the bundles of strands constituting bars of a stator of an electric power generator.
Figure 7:
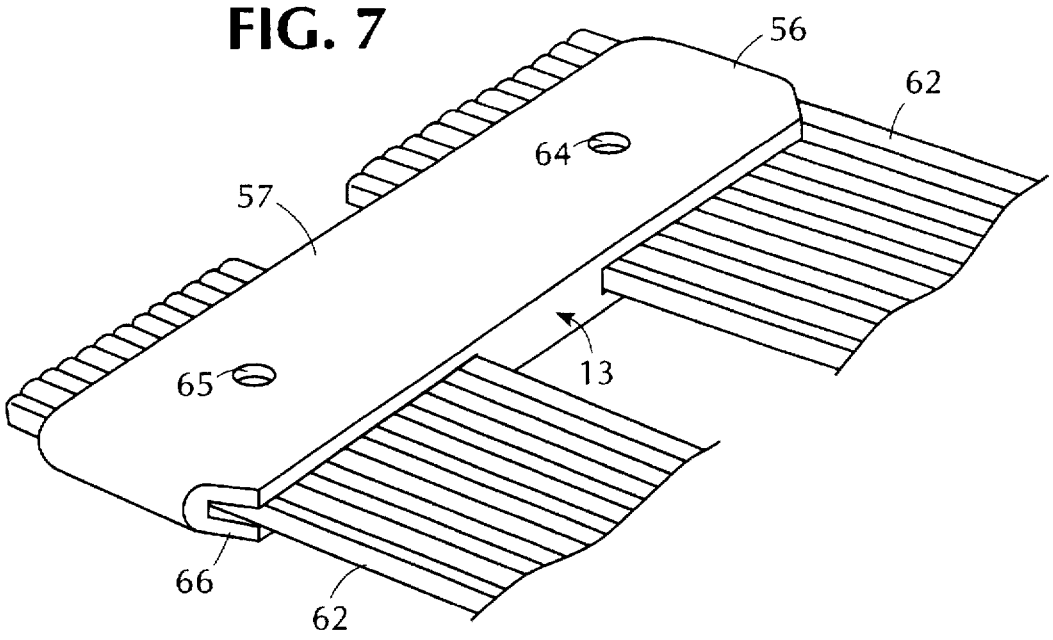
FIG. 7 is a view similar to that of FIG. 6, showing the relationship of the ends of bars with a conductor clip in assembled condition.

One specific application of the tool 10 of the invention is the compression of the clips 13 which join the ends of bars in electric power generator stators. A clip 13 is shown in FIGS. 6 and 7 as having a generally rectangular configuration. The body 56 of the clip 13 has a solid central portion 57, flat upper and lower surfaces 58 and 59 and two parallel slot-like passages 60 and 61, one on each side of the central portion 57.

Each of the slots 60 and 61 is sized to receive neatly and closely the end of a bundle 62 of flat conductors 63 constituting the electrically conductive bar of a generator's stator coil. Each individual conductor 63 is rectangular in cross-section, and the conductors are packed together so that the assembly 62 of conductors 63 is itself rectangular in cross-section, fitting within one of the rectangular slots 60, 61.

It will be understood that if a bar 62 were to be forced to make a return bend in a plane parallel to the width of the bar 62, considerable stress would be experienced by the conductors 63. Therefore, the clip 13 is employed to join ends of the upper and lower bars 62 rather than employing a single return-bent bar, which would be subject to breakages of conductors 63 under stress.

The clip 13 and the conductors 63 are made essentially of copper. The ends of the bars 62 are inserted into the slots 60 and 61 as shown in FIG. 7. The tool 10 is then employed to compress the body 56 by applying pressure to the upper and lower surfaces 58 and 59 of the clip 13 at the areas above and below one of the slots 60 or 61. The compression deforms the bar slightly, squeezing the walls of the slot 60 or 61 around the bar 62.

Silver solder is then fed into the slot 60 or 61. The solder can be fed into the middle portion of the slot 60 or 61 through a hole 64 or 65 provided through the clip body 56 for that purpose. The solder can be heated by any conventional means such as induction heating. Soldering techniques are known and need no detailed description. After the silver soldering the tool 10 can again be used to compress the clip body 56 at the joint.

The same sequence of fitting the bar 62 into the slot, compressing the bar body 56, silver soldering, and again compressing the joint after soldering is followed for each of the slots 60 and 61. This process provides good mechanical and electrical contact between the bars 62 and the clip 13, so that the two bars 62 become, in effect, a single bar with a return bend, forming a loop of a stator coil of the electric power generator.

The clip 13 is shown to have mitered front corners at 66. The particular shape of connector clip is not important; the clip could, for example, have offset end portions, forming an elongated Z-shape in cases where the ends of bars 62 to be joined are somewhat longitudinally displaced from each other.

The tool 10 of the invention can be used for other purposes besides compressing connector clips such as the clip 13. The tool 10 is particularly useful in applications where considerable compressive force is to be applied to an object which is positioned near another fixed object so that comrpession devices requiring relatively large operating room such as conventional vises or presses cannot be used. Such other applications will suggest themselves to those skilled in the art.

What is claimed is:

1. A tool for applying compressive force to an object in a restricted space, comprising: a tool body in the form of a yoke with a central tool portion and two spaced pairs of fixed arms extending from opposite sides of said central portion; a pin extending between the arms of each pair of fixed arms, a pair of opposable jaws, each jaw being pivotably mounted on one of said pins for movement of the jaws away from and towards each other to open and close the jaws; each jaw having a generally flat compression surface and an ear extending perpendicularly with respect to the compression surface; each of said ears having a curved outer camming surface cooperating with a roller mounted on one of said pairs of arms for guiding the compression surfaces of the jaws toward each other along essentially a straight line in mutually parallel relationship as the compression surfaces approach an object to which compressive force is to be applied; and means for opening and closing the jaws comprising a piston and cylinder assembly housing a reciprocably mounted piston rod extending through the central tool portion and a clevis mounted on said piston rod carrying a central pin that extends through aligned and elongated respective holes in mutually overlapping portions of the ears of said jaws, whereby retraction of said piston rod moves the compression surfaces of the jaws towards each other and extension of the piston rod moves the compression surfaces away from each other.

2. The tool of claim 1 wherein the piston rod is fixed to a piston head, within a cylinder chamber of said piston and cylinder assembly.

3. The tool of claim 1 wherein the piston and cylinder assembly is hydraulically actuated.

4. The tool of claim 1 wherein the rollers are carried by pins extending between the arms of the pairs of spaced arms.

5. The tool of claim 1 wherein a coiled spring under compression in cylinder of the piston and cylinder assembly opposes retraction of the piston rod.

6. The tool of claim 1 wherein the central tool portion is barrel-shaped and the piston and cylinder assembly is secured to an end of the central tool portion.

7. The tool of claim 1 including stop means for limiting the closing movement of the jaws.

8. The tool of claim 7 wherein the stop means is a lip projecting from one of the compression surfaces.

9. The tool of claim 1 wherein each said jaw has a pivot hole therein by which it is pivotally mounted on its said one of said pins, each said pivot hole being larger than its said one of said pins to allow said compression surfaces to move towards each other along a substantially straight line.

10. The tool of claim 9 wherein each of said pivot holes has an elongated shape.

11. The tool of claim 1 wherein said laterally elongated holes in the mutually overlapping portions of the ears of said jaws are slot-like.

* * * * *

UNITED STATES PATENT AND TRADEMARK OFFICE

CERTIFICATE OF CORRECTION

PATENT NO. : 5,787,754
DATED : August 4, 1998
INVENTOR(S) : J. Carrion et al.

It is certified that error appears in the above-indentified patent and that said Letters Patent is hereby corrected as shown below:

Column 6, lines 15 and 16, delete "and elongated respective";
line 29, after "in" insert --a--;
line 45, delete "laterally elongated";
line 47, before "slot-like" insert --elongated and--.

Signed and Sealed this

Twenty-fourth Day of November, 1998

Bruce Lehman

*Attest:*

BRUCE LEHMAN

*Attesting Officer*

*Commissioner of Patents and Trademarks*